US011208123B2

(12) United States Patent
Zhang et al.

(10) Patent No.: US 11,208,123 B2
(45) Date of Patent: Dec. 28, 2021

(54) FRAME OF BOGIE

(71) Applicant: CRRC TANGSHAN CO., LTD., Tangshan (CN)

(72) Inventors: Lixin Zhang, Tangshan (CN); Chengwei Qin, Tangshan (CN); Dehua Li, Tangshan (CN); Shun Cao, Tangshan (CN); Jingwei Chen, Tangshan (CN)

(73) Assignee: CRRC TANGSHAN CO., LTD., Tangshan (CN)

( * ) Notice: Subject to any disclaimer, the term of this patent is extended or adjusted under 35 U.S.C. 154(b) by 310 days.

(21) Appl. No.: 16/230,956

(22) Filed: Dec. 21, 2018

(65) Prior Publication Data

US 2019/0126951 A1 May 2, 2019

Related U.S. Application Data

(63) Continuation of application No. PCT/CN2016/102658, filed on Oct. 20, 2016.

(30) Foreign Application Priority Data

Jun. 21, 2016 (CN) ..... 201610451146.7

(51) Int. Cl.
*B61F 5/04* (2006.01)
*B61F 5/24* (2006.01)
(Continued)

(52) U.S. Cl.
CPC ..... *B61F 5/04* (2013.01); *B61F 5/24* (2013.01); *B61F 5/52* (2013.01); *B61F 5/08* (2013.01); *B61F 5/10* (2013.01)

(58) Field of Classification Search
CPC ..... B61F 5/04; B61F 5/06; B61F 5/08; B61F 5/10; B61F 5/26; B61F 5/52; B61F 5/24
See application file for complete search history.

(56) References Cited

U.S. PATENT DOCUMENTS 2,231,195 A * 2/1941 Piron ..... B61F 5/08 105/198.7
2,305,732 A * 12/1942 Piron ..... B61F 5/08 105/194

(Continued)

FOREIGN PATENT DOCUMENTS

CN 201189870 Y 2/2009
CN 201737001 U 2/2011

(Continued)

OTHER PUBLICATIONS

The International Search Report of corresponding International PCT Application No. PCT/CN2016/102658, dated Mar. 22, 2017.

(Continued)

*Primary Examiner* — Zachary L Kuhfuss
(74) *Attorney, Agent, or Firm* — J.C. Patents

(57) ABSTRACT

Disclosed is a frame for a bogie, comprising two side beams parallel to each other and a transverse beam connected to the middles of the side beams, wherein the middle of the transverse beam is provided with a traction pin hole, and an upper surface of the transverse beam is provided with a plurality of mounting seats for mounting a secondary suspension. The frame of the present invention is provided with a traction pin hole at the center of the transverse beam so that the transverse beam is connected to the bolster so as to bear a traction force, and a plurality of mounting seats for mounting the secondary suspension are arranged on an upper surface of the transverse beam, so that the secondary suspension can bear a rotation movement between the bogie and the vehicle body to improve curve passing capability of the vehicle.

14 Claims, 14 Drawing Sheets

(51) Int. Cl.

| | |
|---|---|
| ***B61F 5/52*** | (2006.01) |
| *B61F 5/08* | (2006.01) |
| *B61F 5/10* | (2006.01) |

(56) References Cited

U.S. PATENT DOCUMENTS

| | | | | | |
|---|---|---|---|---|---|
| 3,628,465 | A | * | 12/1971 | Dobson | B61F 5/142 105/191 |
| 3,961,582 | A | * | 6/1976 | Paton | B60G 15/04 105/3 |
| 10,011,287 | B2 | * | 7/2018 | Ma | B60T 7/124 |
| 2004/0123767 | A1 | * | 7/2004 | Nishimura | B61F 5/52 105/157.1 |
| 2012/0318164 | A1 | * | 12/2012 | Shinmura | B61C 17/00 105/138 |

FOREIGN PATENT DOCUMENTS

| | | | | | |
|---|---|---|---|---|---|
| CN | 102923153 | A | | 2/2013 | |
| CN | 102963388 | A | * | 3/2013 | B61F 3/04 |
| CN | 202847719 | U | | 4/2013 | |
| CN | 103625498 | A | | 3/2014 | |
| CN | 103770803 | A | | 5/2014 | |
| CN | 104627196 | A | | 5/2015 | |
| CN | 204472812 | U | | 7/2015 | |
| CN | 105460033 | A | * | 4/2016 | |
| CN | 205273483 | U | | 6/2016 | |
| CN | 105923007 | A | | 9/2016 | |
| CN | 105923007 | A | * | 9/2016 | B61F 5/18 |
| CN | 106004913 | A | * | 10/2016 | B61F 5/30 |
| CN | 106004915 | A | | 10/2016 | |
| CN | 106004915 | A | * | 10/2016 | B61F 5/04 |
| CN | 205916142 | U | | 2/2017 | |
| CN | 205930747 | U | | 2/2017 | |
| JP | 2014-210507 | A | | 11/2014 | |

OTHER PUBLICATIONS

The Chinese First Examination Report of corresponding China patent application No. 201610451146.7, dated Sep. 20, 2017.

The Chinese Second Examination Report of corresponding China patent application No. 201610451146.7, dated Apr. 18, 2018.

* cited by examiner

FRAME OF BOGIE

CROSS-REFERENCE TO RELATED APPLICATIONS

This application is a continuation of International Application No. PCT/CN2016/102658, filed on Oct. 20, 2016, which claims the priority benefit of China Patent Application No. 201610451146.7, filed on Jun. 21, 2016. The contents of the above identified applications are incorporated herein by reference in their entireties.

FIELD OF THE INVENTION

The invention relates to the technical field of a frame of a bogie of a high-speed railway vehicle, in particular to a frame of a bogie.

BACKGROUND OF THE INVENTION

A bogie is an important part of a railway vehicle and is used for carrying the vehicle, providing traction force, damping and guiding, and a power bogie is further used for providing power for driving the railway vehicle to move forward.

The bogie includes a bogie with a bolster and a bogie without bolster, the bogie in the prior art typically comprises a frame, a wheelset, an axle box and the like, wherein the axle box is connected with the frame through a primary suspension, and the frame is connected with the vehicle body through a secondary suspension. The suspension devices typically comprise a resilient support member (e.g., a spring) and a damping member for absorbing energy (e.g, a hydraulic damper). FIG. 15 is a schematic structural view of a bogie in CRH3 series in the prior art, which comprises two side beams, two transverse beams and two longitudinal beams welded together to form an H-shaped box structure, the side beams are a concave U-shaped structure welded by a steel plate, the concave portion of each side beam is provided with an air spring, which is used as a secondary suspension component to be connected with the vehicle body.

The drawback of the prior art is that, when the wheel is in the course of curvilinear motion, rotation and transverse movement between the vehicle body and the bogie are realized only by means of the transverse displacement of the air spring, an allowable offset between the vehicle body and the bogie is small, and it is impossible to pass a small turning radius smoothly. Therefore, the vehicle adopting such bogie has a high requirement for the turning radius of track, thereby increasing construction difficulty and construction cost under the condition of complex terrains.

SUMMARY OF THE INVENTION

In view of the above defect existing in the prior art, a technical problem to be solved in this invention is to provide a frame of a bogie, increasing a relative rotation angle between the vehicle body and the bogie, improving curve passing capability of the vehicle and adaptability of the vehicle to track conditions.

In order to solve the problem, the present invention provides a frame of a bogie comprising two side beams parallel to each other and a transverse beam connected with middles of the side beams, wherein a traction pin hole is formed in the middle of the transverse beam, and a plurality of mounting seats for mounting a secondary suspension is arranged on an upper surface of the transverse beam.

Preferably, the frame is H-shaped.

Preferably, the middles of the side beams are recessed to form a concave portion for mounting the bolster.

Preferably, an elastic sleeve is arranged in the traction pin hole.

Preferably, the secondary suspension comprises a plurality of laminated rubber piles, air springs, spiral steel springs, or any combination thereof.

Preferably, the bogie further comprises a foundation brake device comprising a tread brake unit and a disc brake unit, and two ends of each side beam are respectively provided with a disc brake mounting seat for mounting the disc brake unit, and an inner side of the concave portion of each side beam is provided with a tread brake mounting seat for mounting the tread brake unit.

Preferably, an outer side of the concave portion of each side beam in left-right direction is provided with an anti-yaw damper mounting seat for mounting the anti-yaw damper.

Preferably, an outer side of the concave portion of each side beam in front-rear direction is provided with a rotating arm positioning seat used for mounting a rotating arm axle box.

Furthermore, each side beam is a closed box body welded by a steel plate, the box body comprising a lower cover plate and an upper cover plate that are formed by integral stamping of steel plates, and being internally provided with a vertical plate, and ends of each side beam are welded with steel pipes and forged castings.

Furthermore, the transverse beam is a box-shaped structure welded by a steel plate.

When the bogie is a power bogie, two sides of the transverse beam are provided with motor hanging seats and gearbox hanging seats, the motor hanging seats and the gearbox hanging seats are box-shaped welded structures.

Preferably, the elastic sleeve is a laminated metal-rubber structure.

In the frame of a bogie of the present invention, a traction pin hole is formed in the center of the transverse beam, so that the transverse beam is connected with the bolster through the traction pin hole so as to bear a traction force, an upper surface of the transverse beam is provided with a plurality of mounting seats for mounting a secondary suspension, rotation function of the secondary suspension increases a relative rotation angle between the vehicle body and the bogie when the vehicle passes through a curve, and improves curve passing capability of the vehicle.

DETAILED DESCRIPTION

The present invention will be further described in detail below with reference to the accompanying drawings and specific embodiments, which are not as a limitation of the present invention.

Firstly, it should be noted that a frame and a bolster forming the bogie are independent components, can be independently produced and then assembled, but in order to clearly illustrate the structure of the frame or the bolster, in the specification of the present application, the bogie is introduced as a whole structure including the frame and the bolster forming the bogie, in order to understand the structure and working principle of the bogie. However, this does not mean that the frame and the bolster in this embodiment are not separable.

Figure 1:
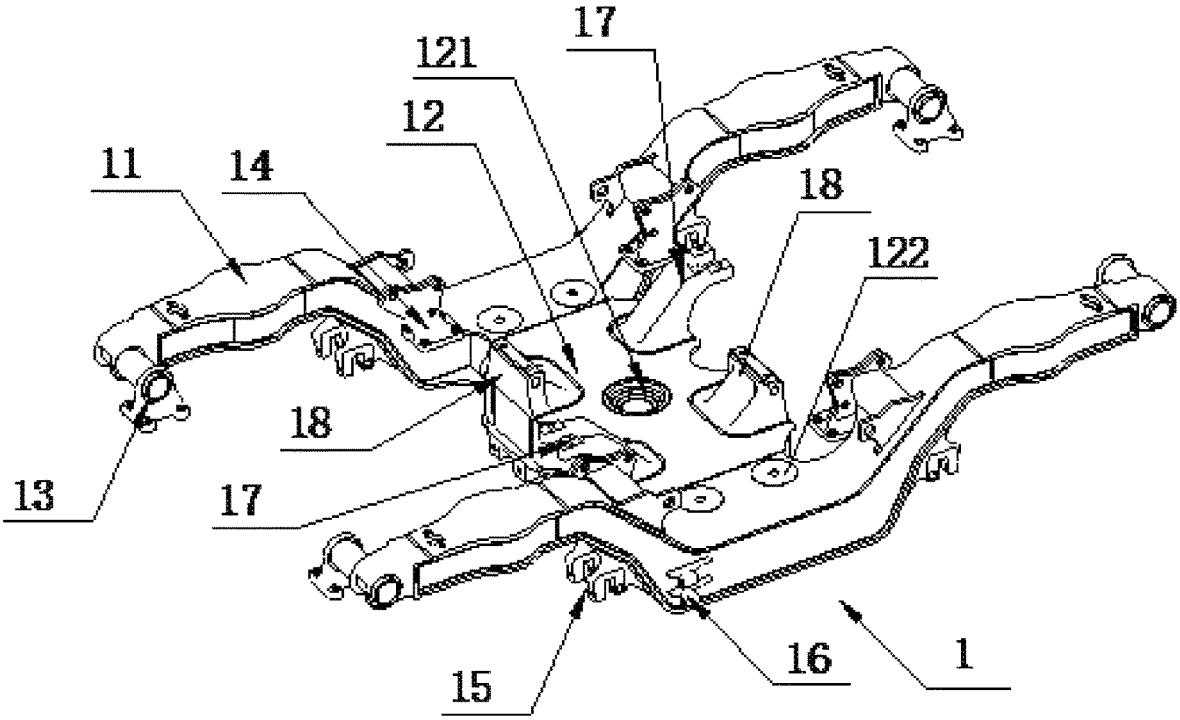
FIG. 1 is a schematic perspective view of a frame of a bogie according to an embodiment of the present invention.
Figure 2:
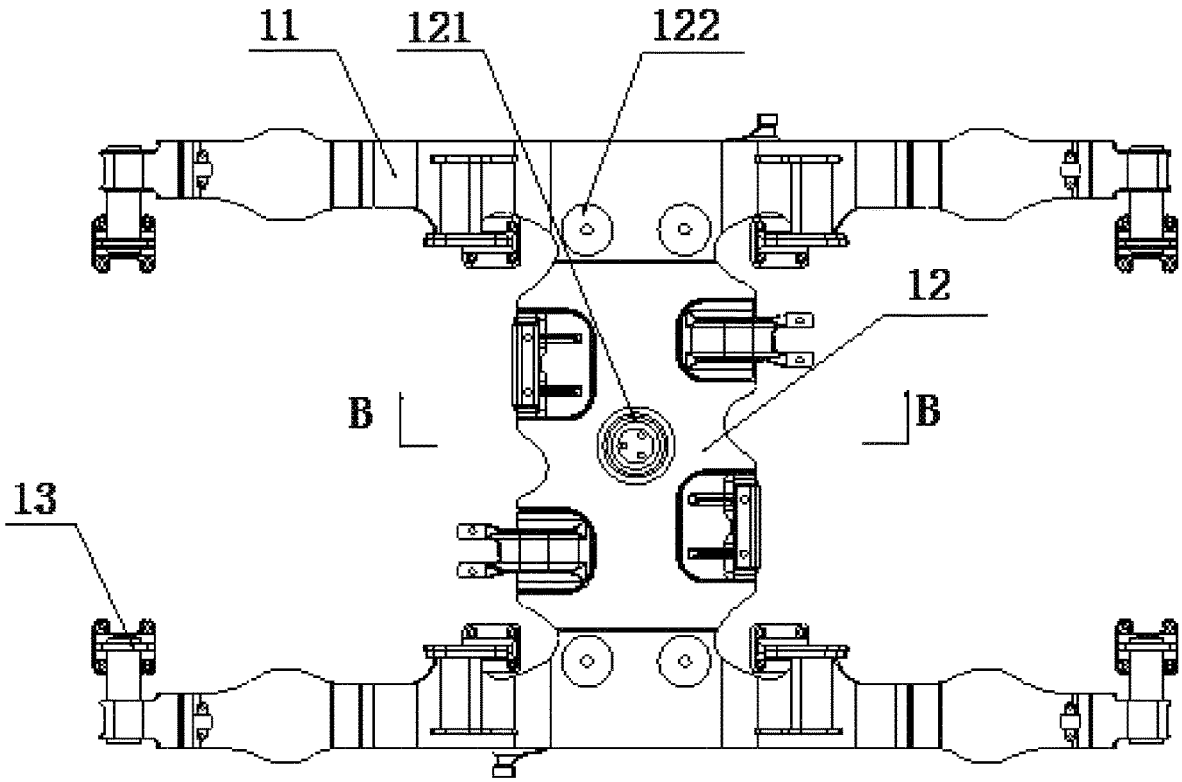
FIG. 2 is a top view of the frame shown in FIG. 1.
Figure 3:
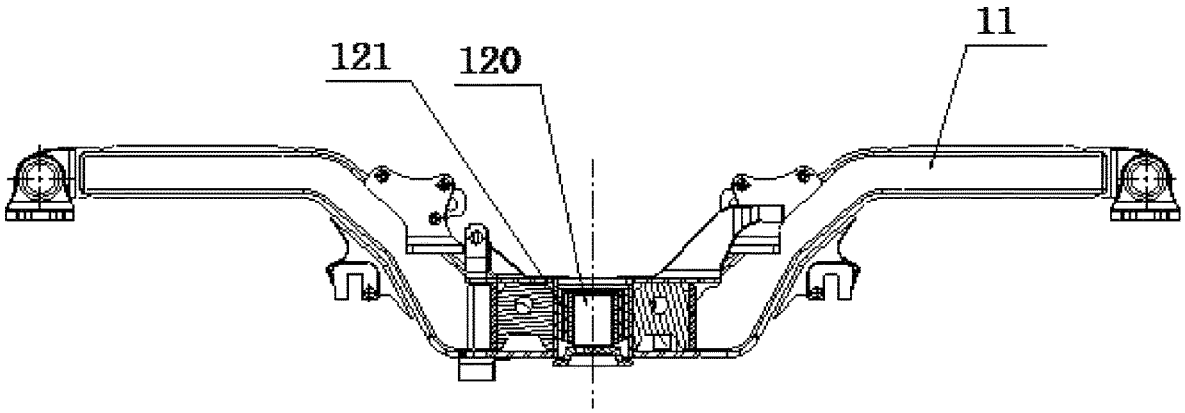
FIG. 3 is a cross-sectional view taken along line B-B of FIG. 2.
Figure 4:
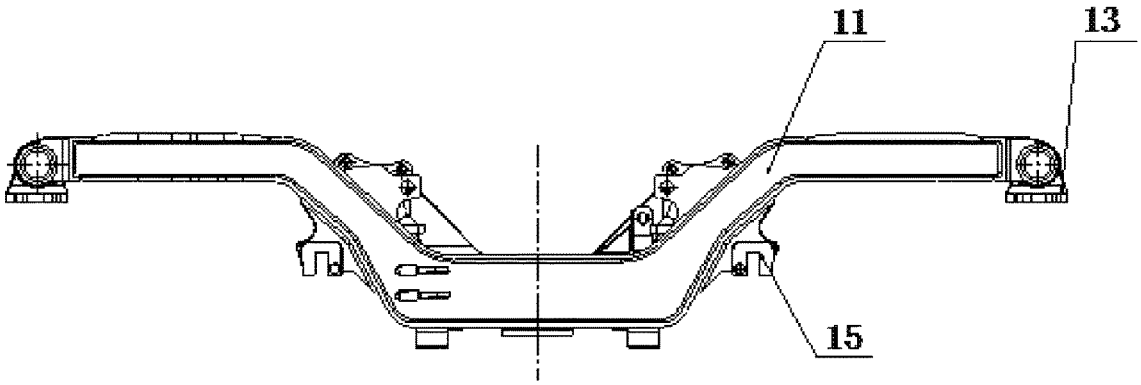
FIG. 4 is a front view of the frame shown in FIG. 1 (viewed from one side of a traveling direction)

FIG. 1 is a schematic perspective view of a frame of a bogie according to an embodiment of the present invention; FIG. 2 is a top view of the frame shown in FIG. 1; FIG. 3 is a cross-sectional view taken along line B-B of FIG. 2; FIG. 4 is a front view of the frame shown in FIG. 1 (viewed from one side of a traveling direction).

Figure 5:
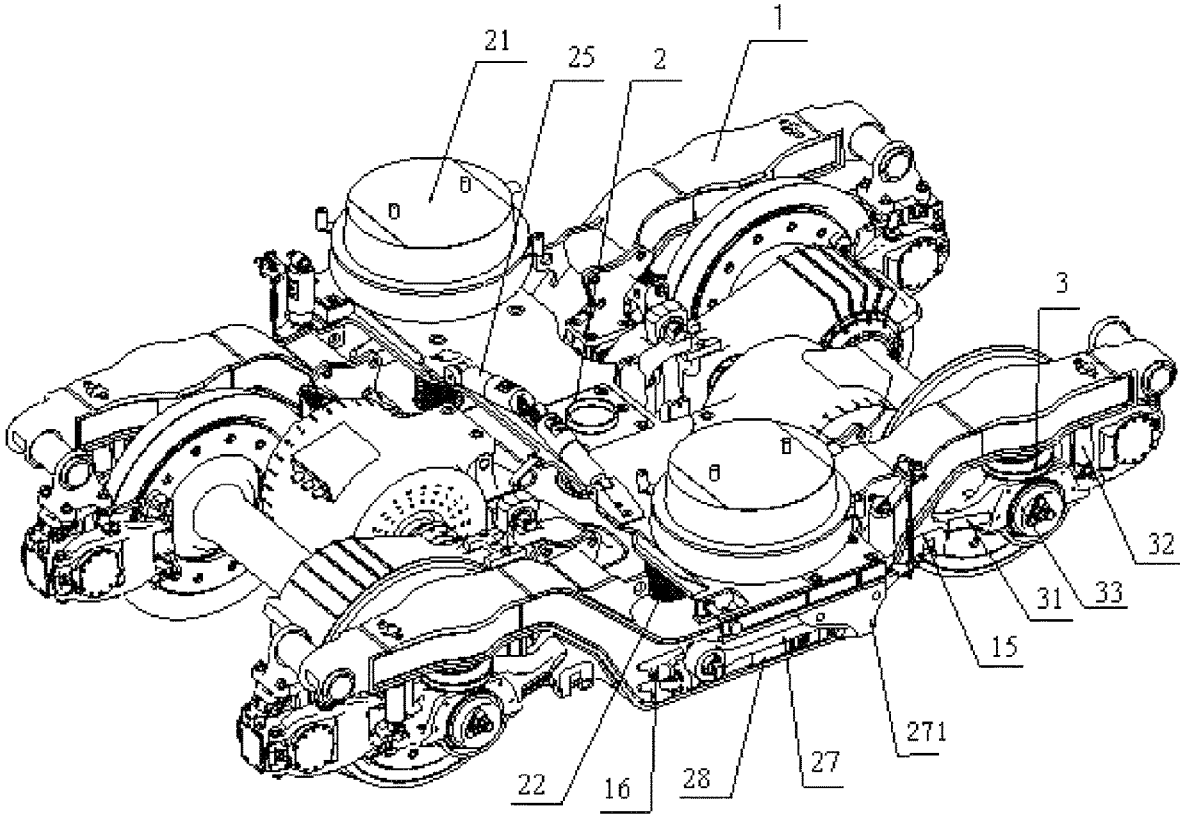
FIG. 5 is a schematic perspective view of a bogie to which a frame of the present invention is applied.
Figure 6:
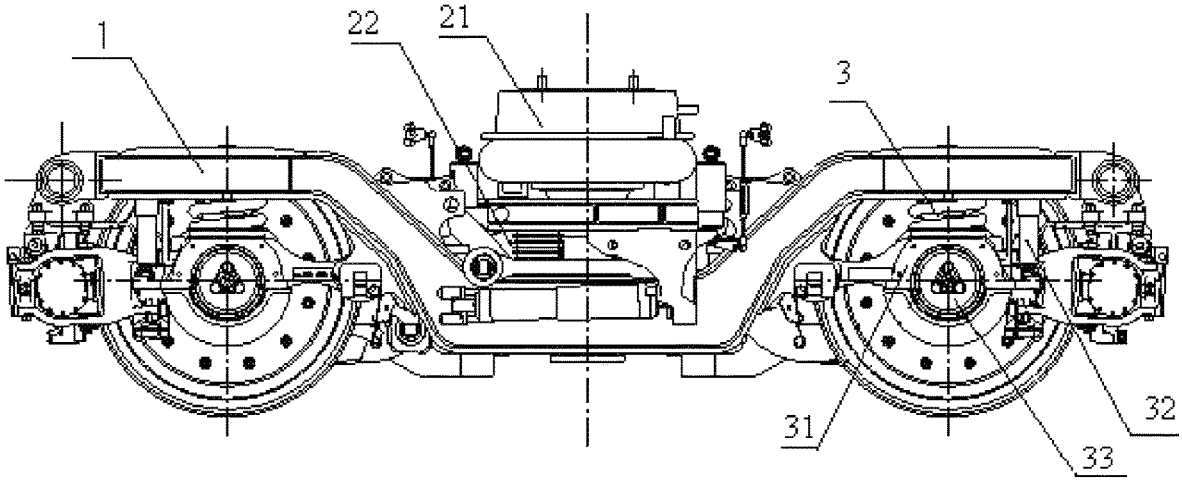
FIG. 6 is a front view of FIG. 5 (viewed from one side of a traveling direction)
Figure 7:
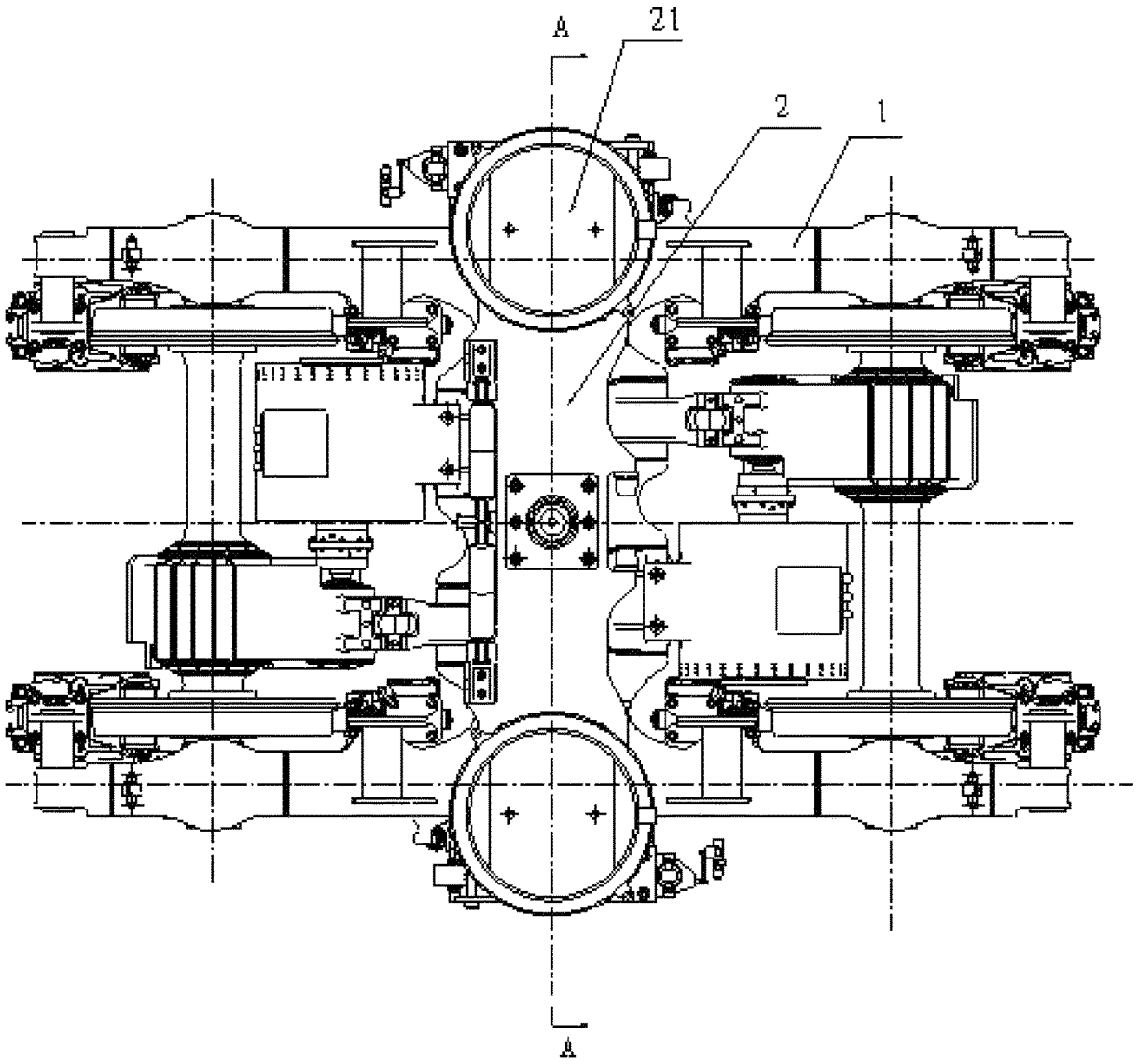
FIG. 7 is a top view of FIG. 5.
Figure 8:
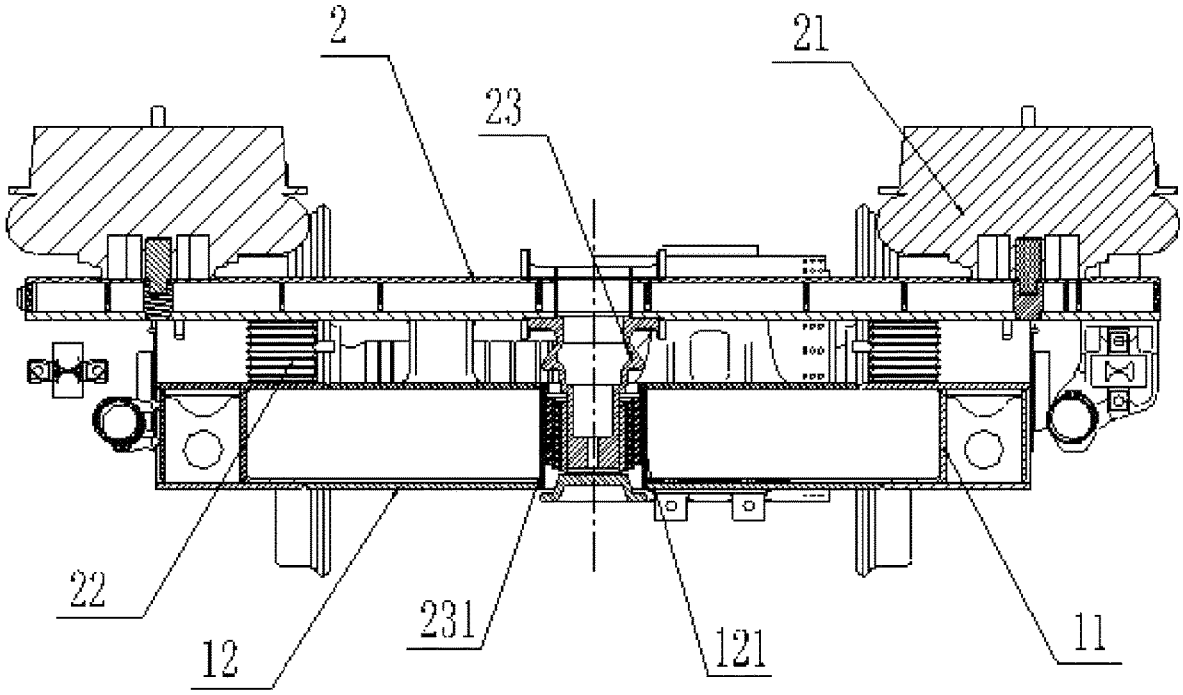
FIG. 8 is a cross-sectional view taken along line A-A of FIG. 7.

FIG. 5 is a schematic perspective view of a bogie to which a frame of the present invention is applied; FIG. 6 is a front view of FIG. 5 (viewed from one side of a traveling direction); FIG. 7 is a top view of FIG. 5; FIG. 8 is a cross-sectional view taken along line A-A of FIG. 7.

Figure 9:
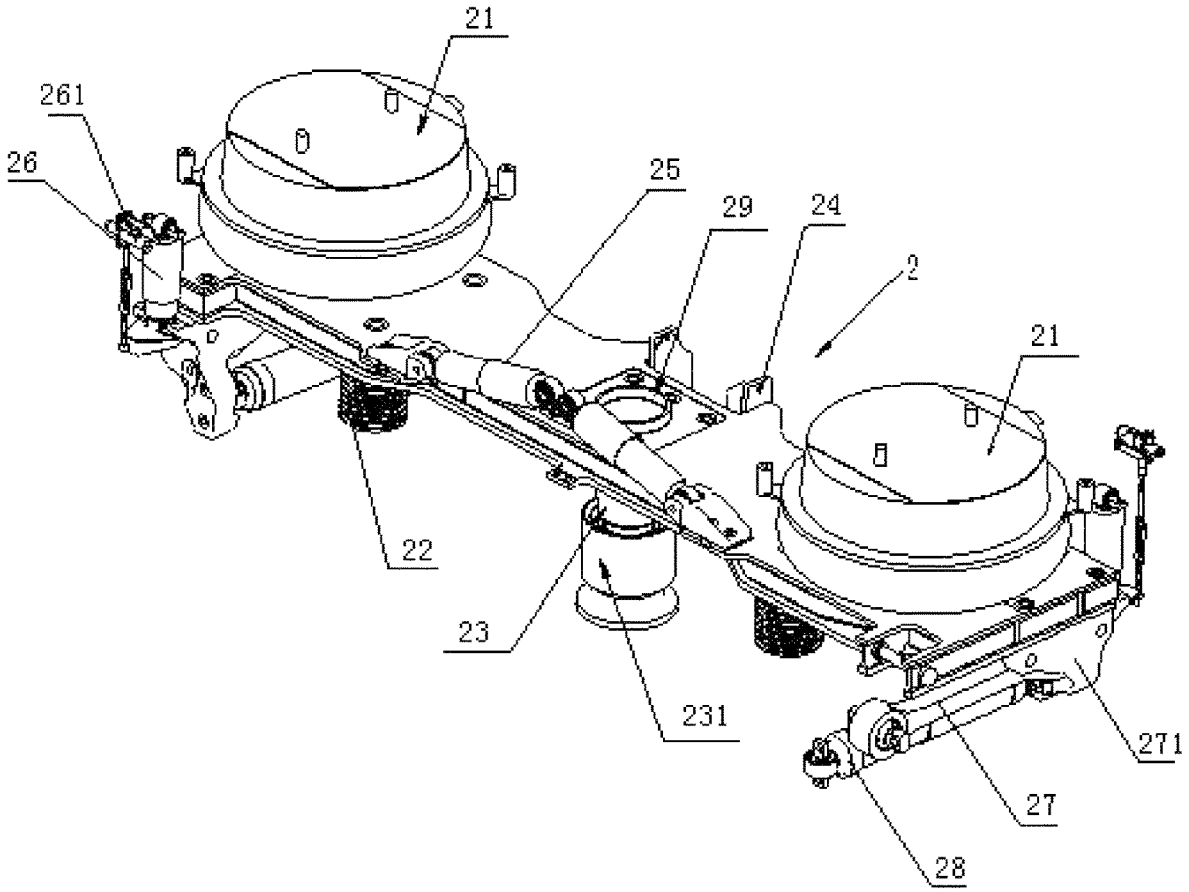
FIG. 9 is a schematic perspective view of a bolster in cooperation with a frame of the present embodiment.
Figure 10:
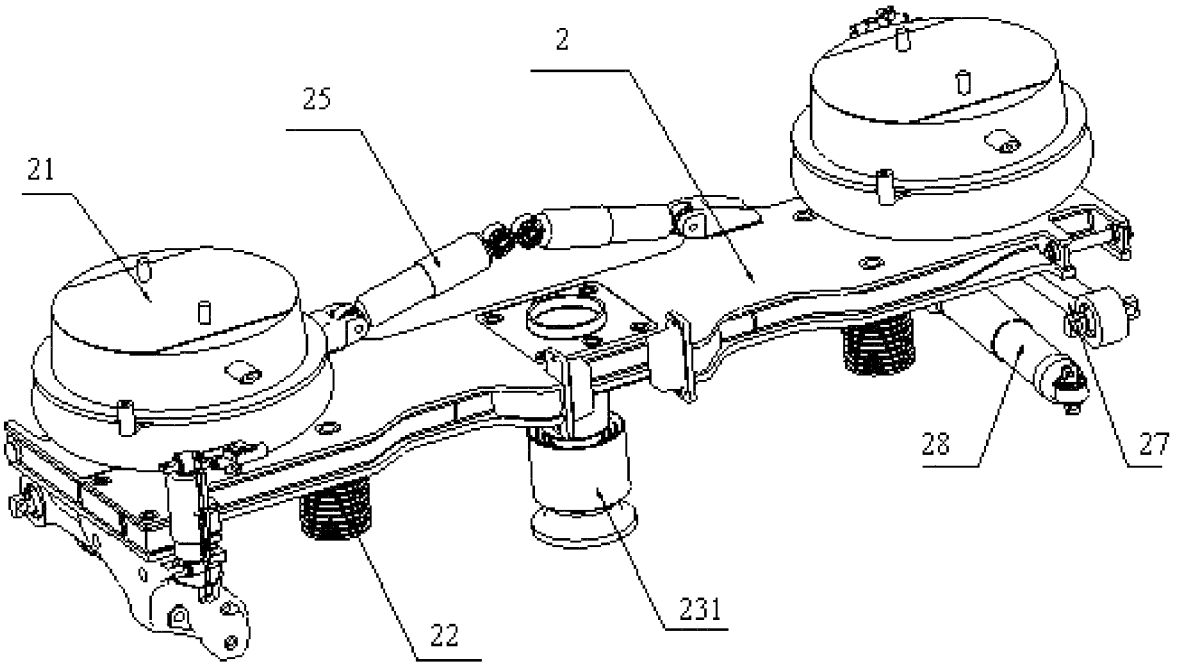
FIG. 10 is a schematic perspective view from another direction in FIG. 9.
Figure 11:
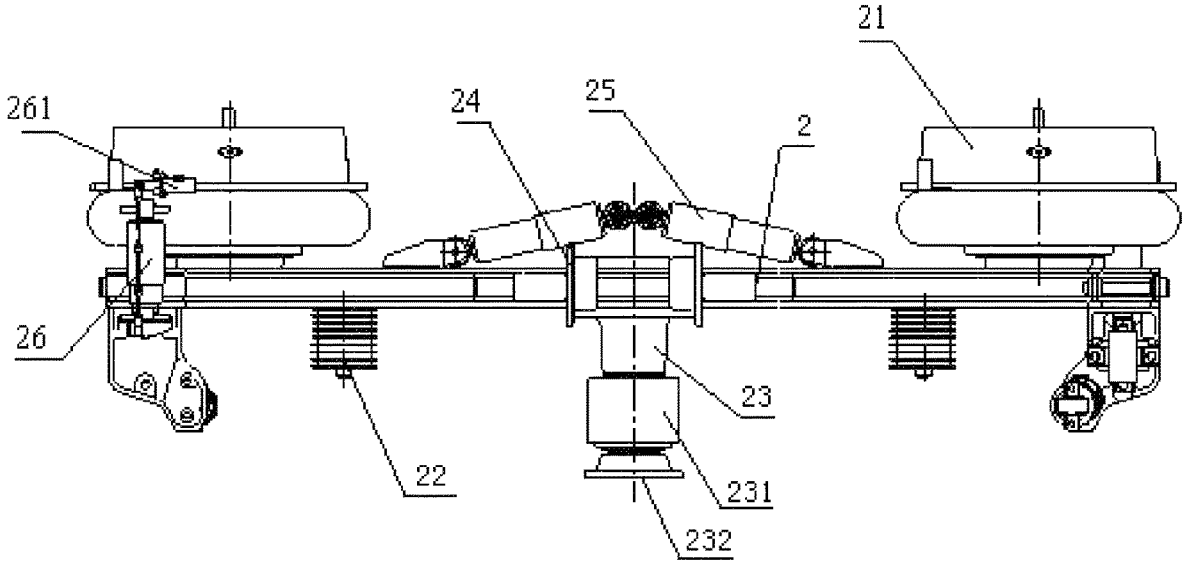
FIG. 11 is a front view of FIG. 9.
Figure 12:
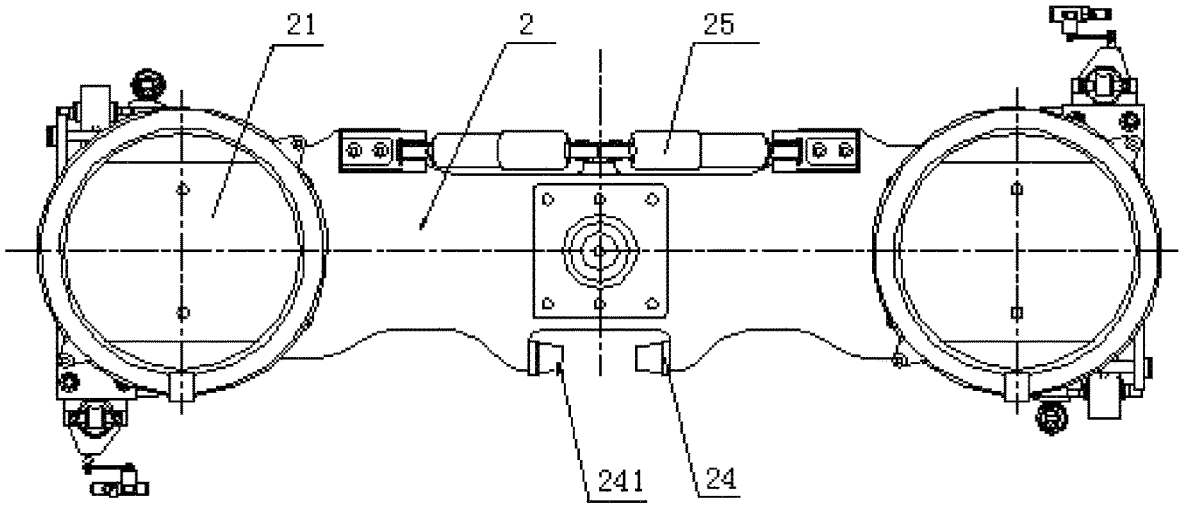
FIG. 12 is a top view of FIG. 11.
Figure 13:
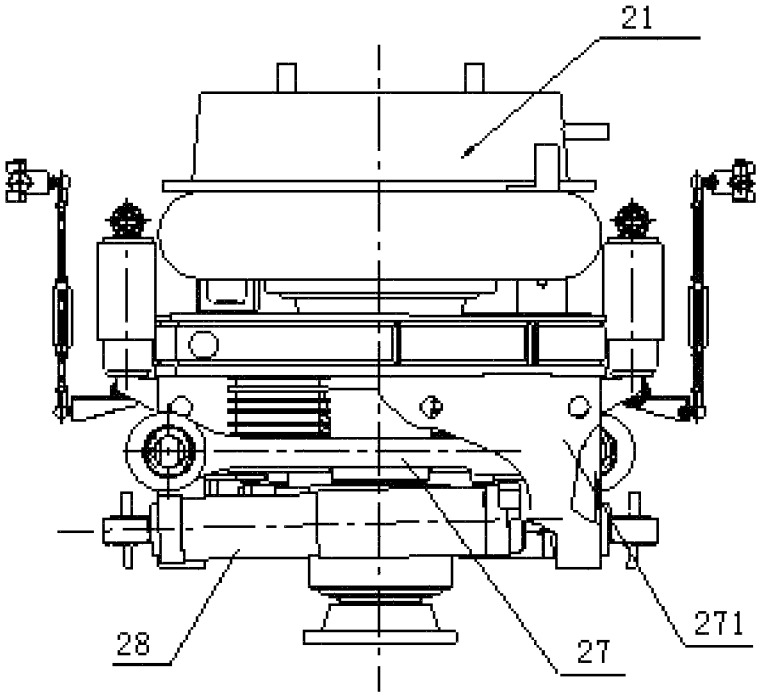
FIG. 13 is a left view of FIG. 11.

FIG. 9 is a schematic perspective view of a bolster in cooperation with the frame of the present embodiment; FIG. 10 is a schematic perspective view from another direction in FIG. 9; FIG. 11 is a front view of FIG. 9; FIG. 12 is a top view of FIG. 11; FIG. 13 is a left view of FIG. 11.

As shown in FIGS. 1-4, a frame 1 of a bogie according to an embodiment of the present invention is H-shaped, and includes two side beams 11 parallel to each other and a transverse beam 12 connected to middles of the two side beams 11, wherein the middles of the two side beams 11 are recessed to form concave portions for mounting a bolster, and the middle of the transverse beam 12 is provided with a traction pin hole 120, and on the upper surface of the transverse beam 12 is provided with a plurality of mounting seats 122 for mounting a secondary suspension. As a preferred embodiment, the traction pin hole 120 is provided with an elastic sleeve 121. The structure and advantages of the frame 1 can be understood in combination with a bogie adopting the frame 1. It should be noted that the number, shape and size of the mounting seat 122 for mounting the secondary suspension, on the upper surface of the transverse beam 12 of the frame 1, are different due to difference in the structure of the supporting member of the secondary suspension, and should match with the structure of supporting member.

Referring to FIGS. 5-8, a bogie of an embodiment of the present invention comprises a frame 1 and a bolster 2. As shown in FIGS. 1-8, the frame 1 is H-shaped, and includes two side beams 11 parallel to each other and a transverse beam 12 connected to the middles of the two side beams 11, wherein the middles of the side beams 11 are recessed into a "U" shape to form concave portions for mounting the bolster 2, and a primary suspension is arranged between a rotating arm axle box 31 and each of both ends of each side beam 11 and, a secondary suspension is arranged between a lower side of the bolster 2 and the transverse beams 12, and a third suspension connected with the vehicle body is arranged on an upper side of the bolster 2. In the present embodiment, the primary suspension includes an axle box spring 3 and a primary vertical damper 32, both of which are arranged between the rotating arm axle box 31 and the frame 1, wherein the axle box spring 3 is a double coil steel spring, and is placed on the top of the rotating arm axle box 31, and the upper half of the spring extends into a spring seat of the side beam 11 of the frame 1, a rubber pad is provided between the bottom of the spring 3 and the top of the rotating arm axle box 31 so as to absorb impact and high frequency vibration from the rail. The function of the primary vertical damper 32 is to reduce the vibration from the rail, which is a common design and will not be described herein. The present invention is characterized in that a two-stage suspension connection is provided between the vehicle body and the frame, that is, a third suspension that is arranged on the upper side of the bolster 2 and connected to the vehicle body, and a secondary suspension that is arranged between the lower portion of the bolster 2 and the transverse beam 12, to achieve functional separation. Specifically, the third suspension is only used to undertake a transverse displacement function, and the secondary suspension is only used to undertake a rotation function, thereby increasing an allowable transverse displacement and relative rotation angle between the vehicle body and the bogie when the vehicle passes through a curve, and thus improving curve passing capability of the vehicle. Wherein the secondary suspension is fixedly provided on the lower surface of the bolster 2, and correspondingly, the middle of the transverse beam 12 is provided with a traction pin hole 120, the upper surface of the transverse beam 12 of the frame 1 is provided with a plurality of mounting seats 122 for mounting the secondary suspension. In order to achieve the structure of the bogie with a three-stage suspension, correspondingly, the middle of the side beam 11 of the frame 1 is concave downwards to form a U-shape, and a traction pin hole 120 is formed in the middle of the transverse beam 12, the upper surface of the cross beam 12 is provided with a plurality of mounting seats 122 for mounting the secondary suspensions.

As shown in FIGS. 5-8, in the present embodiment, the third suspension adopts an air spring 21 as a supporting member, the air spring ensures that the height of the vehicle remains unchanged, and a height adjusting valve 261 is arranged beside the air spring 21. The vehicle body is supported by four air springs on a front bogie and a rear bogie. In addition to support the load of the vehicle body, these air springs are mainly used to isolate vibration the frame of the bogie, and achieve transverse displacement between the vehicle body and the bogie by deformation in the process of passing a curve. The air spring 21 is a conventional technical means in the art and is not described in detail herein.

Figure 14:
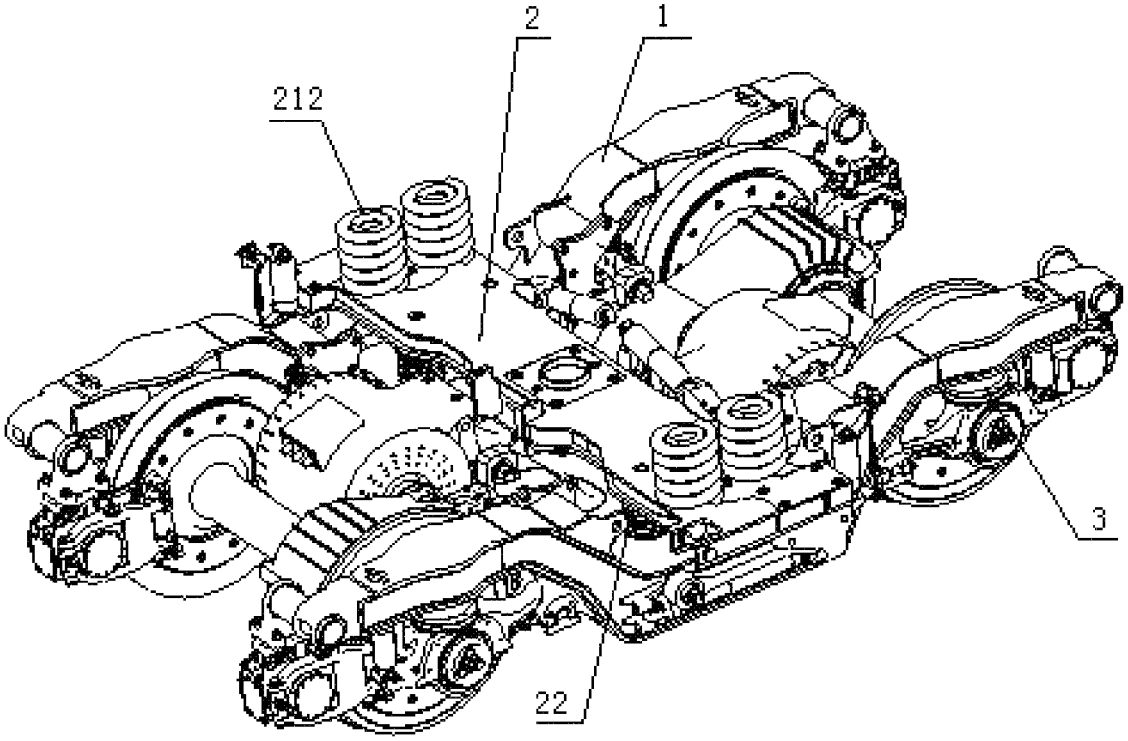
FIG. 14 is a schematic perspective view of a bogie in another embodiment to which a frame of the present invention is applied.
Figure 15:
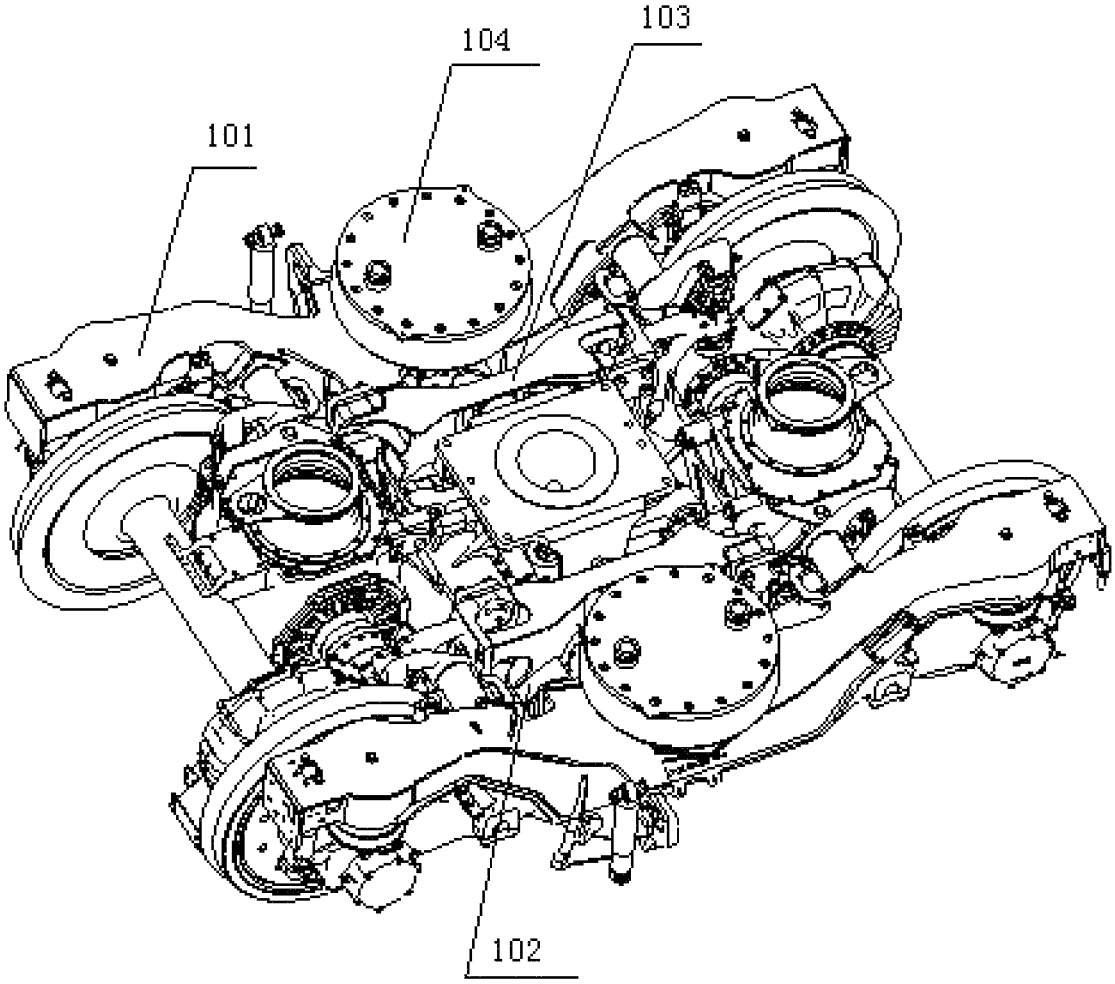
FIG. 15 is a schematic perspective view showing the structure of a bogie in the prior art.

However, the supporting member of the third suspension is not limited to the air spring 21, and in another embodiment shown in FIG. 14, a spiral steel spring 212 is adopted to replace the air spring 21. It is obvious that there are a plurality of spiral steel springs 212, which are symmetrically distributed at two ends of the bolster 2. A person skilled in the art can also use a combination of an air spring and a spiral steel spring, as the supporting member of the secondary suspension. Similarly, in the present embodiment, the secondary suspension includes a plurality of laminated rubber piles 22, wherein the laminated rubber piles 22 can be replaced with the air spring or the spiral steel spring, or any combination of the laminated rubber pile, the air spring and the spiral steel spring. In this embodiment, the secondary suspension adopts the laminated rubber piles to bear forces in all directions and then attenuates part of the vibration by damping characteristic of the rubber, thereby playing a role of suspension. The main function of the secondary suspension is to undertake rotation function of the vehicle body and the bogie when the vehicle passes through a curve. Due to an alternate arrangement of the metal plate and the rubber in the laminated rubber piles, the laminated rubber piles can provide great vertical stiffness and minimal horizontal stiffness; and reduce rotation stiffness between the frame 1 and the bolster 2 and thus facilitates the bogie to pass through a curve. Meanwhile the great vertical stiffness will provide sufficient lateral roll stiffness for the bogie, so that flexibility coefficient of the bogie meets the overall requirement of the bogie. In order to avoid instability after excessive horizontal displacement of the laminated rubber piles, transverse spans of the laminated rubber piles should be reduced as much as possible on the premise of satisfying rolling performance of the vehicle. When the vehicle passes through a curve, due to large radial deformations of the laminated rubber piles, the bolster 2 (and the vehicle body connected with the bolster) has relatively large rotational movement relative to the frame 1, improving the curve passing capability of the vehicle.

In order to transfer the longitudinal load between the vehicle body and the bogie, in this embodiment, a Z-shaped traction rod 27 is arranged between the vehicle body and the bolster, and a traction pin 23 is arranged between the bolster 2 and the frame 1. As shown in FIGS. 5-7, a traction pin hole 120 is formed in the middle of the transverse beam 12 of the frame 1, and correspondingly, as shown in FIGS. 9-11, the traction pin 23 is arranged in the middle of the lower side of the bolster 2, the bolster 2 is connected with the transverse beam 12 through the traction pin 23, and the traction pin 23 is sleeved with an elastic pin sleeve 231. The elastic pin sleeve 231 is in a laminated metal-rubber structure. As a preferred embodiment, an elastic pin hole sleeve 121 is arranged on the traction pin hole 120, and the pin hole sleeve 121 can also be a laminated metal-rubber structure. In this way, a pin connection is formed between the traction pin 23 and the traction pin hole 120, and the design goal of bogie having no lubrication point is achieved, which can meet the requirements of small rotation stiffness, small vertical stiffness (axial stiffness), and great longitudinal and transverse stiffness (radial stiffness), reduce the effect on rotation between the frame 1 and the bolster 2 of the bogie, and provide the transmission of longitudinal and transverse loads. The Z-shaped traction rod, forming a Z-shape when seeing from a top view, comprises two traction rods 27, which are located at two ends of the bolster 2 respectively. In order to install the traction rods 27, as shown in FIGS. 9 and 13, the two ends of the bolster 2 are respectively provided with a first mounting seat 271, and one end of each traction rod 27 is arranged on a corresponding first mounting seat 271, the other end of each traction rod 27 is provided with a rubber node for connecting with the vehicle body (not shown). Thus, a transmission sequence of a longitudinal force (traction force or braking force) is as follows: (wheel-rail adhesion) wheel→axle→rotating arm axle box→rotating arm positioning seat→frame→traction pin (third suspension)→bolster→traction rod→traction rod seat→vehicle body coupler.

As shown in FIGS. 9 and 12, a transverse buffer 24 is arranged in the middle of one side of the bolster 2, the transverse buffer 24 is in an open shape, and two opposite stop side surfaces thereof are respectively provided with a buffer rubber 241. A stop (not shown) connected with the vehicle body is located in the open of the transverse buffer 24, and keep a set distance with the two stop side surfaces. The function of the transverse buffer 24 is to limit an excessive transverse displacement between the vehicle body and the bogie, and when the transverse displacement between the vehicle body and the bogie exceeds the set distance, the stop connected with the vehicle body is in contact with the buffer rubber 241 on one of the stop side surfaces of the transverse buffer 24, and then a reverse compression force is generated, which can limit the transverse displacement of the vehicle. The buffer rubber has a non-liner performance, and its stiffness is gradually increasing with the increase of deflection. The transverse buffer 24 can provide limiting and buffering when the vehicle body is subjected to a small transverse force.

In addition, referring to FIG. 9, a central pin hole 29 is formed in the middle of the upper side of the bolster 2, and is used for accommodating a rigid stop pin (not shown) arranged in the center of a bolster of the vehicle body. The rigid stop pin arranged in the center of the bolster of the vehicle body is welded on the bolster of the vehicle body and can be inserted into the central pin hole 29 in the center of the bolster 2 of the bogie, and there is always a certain gap kept between the rigid stop pin and the central pin hole in longitudinal direction and vertical direction during normal operation of the vehicle, and no contact occurs. When the vehicle is subjected to a large longitudinal force (for example, when two vehicles collide), the rigid stop pin of the bolster of the vehicle body is in contact with the central pin hole 29 on the bolster 2 so as to limit the separation of the vehicle from the bogie. When the vehicle is subjected to a large transverse force, the buffer rubber 241 of the transverse buffer 24 is elastically compressed, and then the rigid stop pin will be in contact with the central pin hole 29 so as to limit an overlarge transverse displacement of the vehicle. Strength of the structure of the stop pin should be such that the structure does not break when the vehicle is subjected to an impact force of 250,000 pounds (113397.5 kg) in the event of collision, derailment and the like.

In order to achieve the purpose of vibration reduction, dampers are generally arranged in multiple directions in a suspension system. For example, as shown in FIGS. 9 to 12, two transverse dampers 25 are oppositely arranged on one side of the bolster 2, one end of each transverse damper 25 is connected with the bolster 2, and the other end of each transverse damper 25 is connected with the bottom (not shown) of the vehicle body, and the function of the transverse dampers is to attenuate transverse vibration between the vehicle body and the bogie. The transverse dampers 25 and the transverse buffer 24 are located on opposite two sides of the bolster 2 respectively.

Meanwhile, in order to further reduce vibration in vertical direction, two ends of the bolster 2 are respectively provided with a secondary vertical damper 26, the secondary vertical damper 26 is arranged beside corresponding air spring 21. Two secondary vertical dampers are opposite to each other and diagonally symmetrically arranged at the two ends of the bolster 2 and are arranged in vertical direction, with the function of attenuating vertical vibration between the vehicle body and the bogie. In addition, an orifice is formed between an airbag chamber and an additional air chamber, inside the air spring 21, and the flow of air through the orifice between the two chambers can also be used for attenuating the vertical vibration between the vehicle body and the bogie.

As shown in FIG. 9 and FIG. 13, the bogie of the present embodiment further comprises an anti-yaw damper 28, one end of the anti-yaw damper 28 is arranged on the first mounting seat 271, and the other end is connected with the side beam 11 of the frame 1. The anti-yaw damper 28 that is arranged between the bolster 2 and the frame 1 can prevent yaw instability of a multiple-unit train during high-speed running. The anti-yaw damper 28 is a component frequently used in a high-speed multiple-unit train design, and its structure will not be described in detail herein.

The bogie of the present embodiment further comprises a foundation brake device, and the foundation brake device comprises a tread brake unit and a disc brake unit. As shown in FIG. 1, two ends of each side beam 11 are respectively provided with a disc brake mounting seat 13 for mounting the disc brake unit, and an inner side of the concave portion of each side beam 11 is provided with two tread brake mounting seats 14 for mounting the tread brake unit. The tread brake unit and the disc brake unit are brake units commonly used in the field, and in the present embodiment, mounting positions of them are set according to the structure of the frame 1. Furthermore, the disc brake unit is used in combination with the tread brake unit, and the tread brake unit can improve adhesion between the wheel and the track and reducing running noise.

When the bogie is a power bogie, as shown in FIG. 1, motor hanging seats 18 and gearbox hanging seats 17 are arranged on the front side and the rear side of the transverse beam 12, both the motor hanging seats 18 and the gearbox hanging seats 17 are box-shaped welded structures, have the advantages of high strength and light weight. In order to reduce the weight, the motor hanging seats 18 and the gearbox hanging seats 17 of the present embodiment are welded structures. In fact, the motor hanging seats 18 and the gearbox hanging seats 17 can also be formed by forgings or castings.

Regarding the structure of the bolster 2, the bolster 2, as a load transfer member of the secondary suspension and the third suspension, integrates mounting interfaces of all components of the secondary suspension and the third suspension, and in the prior art, the bolster has three structural modes, steel plate welded structure, integral cast steel structure and integral cast aluminum structure respectively. In this embodiment, preferably, the bolster 2 adopts a box-shaped structure welded by a steel plate and internally provided with an internal rib plate. After completion of welding, the bolster 2 is integrally annealed and integrally machined to form a hollow box-shaped structure, as shown in FIG. 8.

Regarding the structure of the frame 1 as a basis for mounting other parts, as shown in FIG. 1, in order to correspond to the concave structure of the side beam, an outer side of the concave portion of each side beam 11 in front-rear direction is provided with a rotating arm positioning seat 15 for mounting a rotating arm axle box. An outer side of each side beam 11 in left-right direction is provided with an anti-yaw damper mounting seat 16 for mounting the anti-yaw damper. Referring to FIG. 5, one end of the anti-yaw damper 28 is connected with the anti-yaw damper mounting seat 16 on the side beam 11, and the other end is connected with the first mounting seat 271 on the bolster.

For the sake of weight reduction, in this embodiment, the side beam 11 is a closed box body welded by steel plate, includes a lower cover plate and an upper cover plate that are formed by integral stamping of a steel plate and is internally provided with a vertical plate, and two ends of each side beam 11 are welded with steel pipes and forged castings; the transverse beam 12 is also a box-shaped structure welded by steel plate. In the cross-sectional view shown in FIG. 4, the side beams 11 and the transverse beam 12 are all hollow structures.

The primary suspension in the embodiment is additionally described below. As shown in FIG. 5, in the embodiment, an axle box positioning device of the primary suspension adopts a mature rotating arm type elastic positioning mode, and one end of the rotating arm axle box 31 is connected with a bearing 33 of the wheelset, and the other end is connected with the rotating arm positioning seat 15 that is arranged on the front side or the rear side of the concave portion of each side beam 11, an elastic node of the rotating arm axle box 31 is a movable joint for connecting the wheelset and the frame, and in addition to transmitting force and vibration in all directions, the axle box must guarantee that the wheelset can adapt to the track condition to run up and down and transverse move left and right relative to the frame. The rotating arm axle box 31 is a mature technology for the primary suspension and is not further described in detail.

With regard to the terms, in the claims and embodiments of the present application, the suspension structures adopted in the bogie are called as primary suspension, secondary suspension and third suspension in the order from bottom to top. In addition, in "first laminated rubber pile", "first air spring", "first spiral steel spring", "second laminated rubber piles" and similar expressions, the "first" and "second" are only used for distinguishing different parts of the same kind.

In addition, in the above embodiments, the frame 1 is taken as an example for description, it should be understood by those skilled in the art that the frame 1 is not necessarily H-shaped, it can also be in the shape of "⊦", "日" and the like, the object of the present invention can be achieved as long as the frame is such a structure that includes the two side beams and a transverse beam connected with the middle of the two side beams. In order to reduce the overall center of gravity and to meet the need for high-speed stable operation of the vehicle, in the above-described embodiments, the middle of each side beam is recessed to form a concave portion for mounting the bolster. In fact, in other application environments, in the case that the side beams are kept in a straight structure and the middles of the side beams are not concave, a three-stage suspension structure can also be realized, except that the center of gravity of both the bolster and the vehicle body above the bolster is raised.

Certainly, the descriptions above are only preferred embodiments of the invention, and it should be noted that a number of improvements and modifications can be made by those skilled in the art without departing from the principle of the invention, and these improvements and modifications are also within the scope of the invention.

What is claimed is:

1. A frame of a bogie comprising two side beams parallel to each other and a transverse beam connected to middles of the side beams, wherein a central portion of the transverse beam is provided with a traction pin hole, an upper surface of the transverse beam is provided with a plurality of mounting seats for mounting a secondary suspension, wherein an elastic sleeve is provided in the traction pin hole; wherein the elastic sleeve is a laminated metal-rubber structure.

2. The frame of the bogie according to claim 1, wherein the frame is H-shaped.

3. The frame of the bogie according to claim 1, wherein the middles of the side beams are recessed to form a concave portion for mounting a bolster.

4. The frame of the bogie according to claim 1, wherein the secondary suspension comprises a plurality of laminated rubber piles, air springs or spiral steel springs, and any combination thereof.

5. The frame of the bogie according to claim 1, wherein two ends of each side beam are respectively provided with a disc brake mounting seat for mounting a disc brake unit and an inner side of the concave portion of each side beam is provided with a tread brake mounting seat for mounting a tread brake unit.

6. The frame of the bogie according to claim 1, wherein an outer side of the concave portion of each side beam in a direction perpendicular to the two side beams is provided with an anti-yaw damper mounting seat for mounting an anti-yaw damper.

7. The frame of the bogie according to claim 1, wherein an outer side of the concave portion of each side beam in a direction parallel to the two side beams is provided with a rotating arm positioning seat for mounting a rotating arm axle box.

8. The frame of the bogie according to claim 1, wherein each side beam is a closed box body formed by welding a steel plate, the box body comprising a lower cover plate and an upper cover plate that are formed by integral stamping of steel plates, and being internally provided with a vertical plate, and ends of each side beam are formed by welding steel pipes and forged castings.

9. The frame of the bogie according to claim 1, wherein the transverse beam is a box-shaped structure formed by welding a steel plate.

10. The frame of the bogie according to claim 1, wherein two sides of the transverse beam are provided with motor hanging seats and gearbox hanging seats, the motor hanging seats and the gearbox hanging seats are all box-shaped welded structures.

11. The frame of the bogie according to claim 3, wherein the secondary suspension is arranged between a lower side of the bolster and the transverse beam, and a third suspension is arranged on an upper side of the bolster and connected to a vehicle body.

12. The frame of the bogie according to claim 3, wherein two Z-shaped traction rods are located at two ends of the bolster.

13. The frame of the bogie according to claim 3, wherein a traction pin is arranged in the middle of a lower side of the bolster, the bolster is connected with the transverse beam through the traction pin.

14. The frame of the bogie according to claim 13, wherein the traction pin is sleeved with an elastic pin sleeve.

* * * * *